US007318304B2

(12) United States Patent
Hiddink et al.

(10) Patent No.: US 7,318,304 B2
(45) Date of Patent: Jan. 15, 2008

(54) DEVICE FOR INTRODUCING PHARMACEUTICAL PRODUCTS INTO BLISTER PACKS

(75) Inventors: Daniel Hiddink, Zug (CH); Andreas Gabriel, Muserhof (CH); Urs Barmettler, Brunnen (CH)

(73) Assignee: HMH Maschinenhandel, Hünenberg (CH)

( * ) Notice: Subject to any disclaimer, the term of this patent is extended or adjusted under 35 U.S.C. 154(b) by 99 days.

(21) Appl. No.: 10/552,286

(22) PCT Filed: Mar. 26, 2004

(86) PCT No.: PCT/CH2004/000185

§ 371 (c)(1),
(2), (4) Date: Oct. 4, 2005

(87) PCT Pub. No.: WO2004/089756

PCT Pub. Date: Oct. 21, 2004

(65) Prior Publication Data

US 2006/0191953 A1 Aug. 31, 2006

(30) Foreign Application Priority Data

Apr. 8, 2003 (CH) ..... 0631/03

(51) Int. Cl.
*B65B 5/08* (2006.01)
*B65B 35/56* (2006.01)
*B65B 35/06* (2006.01)

(52) U.S. Cl. ..... 53/246; 53/248; 141/67; 141/114; 198/786; 209/618; 209/667; 221/168; 221/173; 221/289

(58) Field of Classification Search ..... 53/158, 53/235, 237, 244, 246–248; 141/67, 114; 198/785, 786; 209/618, 667; 221/161, 162, 221/168, 173, 289
See application file for complete search history.

(56) References Cited

U.S. PATENT DOCUMENTS 477,093 A * 6/1892 Wead ..... 198/389
1,463,338 A * 7/1923 Schroeder ..... 221/162

(Continued)

FOREIGN PATENT DOCUMENTS

DE 100 26 496 11/2001

(Continued)

OTHER PUBLICATIONS

International Search Report dated Feb. 7, 2004, corresponding to International Application No. PCT/CH2004/000185.

*Primary Examiner*—Stephen F Gerrity
(74) *Attorney, Agent, or Firm*—Cohen Pontani Lieberman & Pavane LLP

(57) ABSTRACT

Pairs of first and second rolls are supported for rotation in a roll frame located below a pan for receiving pharmaceutical products loaded as bulk material, each first roll having a plurality of axially successive non-cylindrical sections separated from respective non-cylindrical sections of a respective second roll by a gap, the first and second rolls of each pair being rotated in opposite directions so that surfaces of the rolls facing the gap move upwards. An isolating block having a matrix array of isolating channels is positioned below the rolls for receiving pharmaceutical products from respective gaps and for distributing these products to respective individual wells of a blister pack in a single machine cycle.

14 Claims, 7 Drawing Sheets

U.S. PATENT DOCUMENTS

| | | | | | |
|---|---|---|---|---|---|
| 2,155,378 | A | * | 4/1939 | Albertoli | 209/539 |
| 2,597,930 | A | * | 5/1952 | Grosvenor | 198/786 |
| 2,828,888 | A | | 4/1958 | Nicolle | |
| 2,829,476 | A | | 4/1958 | Engleson et al. | |
| 2,877,680 | A | * | 3/1959 | Brown | 411/393 |
| 3,297,130 | A | * | 1/1967 | Greck | 198/383 |
| 3,675,755 | A | * | 7/1972 | Hopwood-Jones | 198/383 |
| 3,687,263 | A | * | 8/1972 | Randrup | 198/383 |
| 4,434,886 | A | * | 3/1984 | Fajt | 198/389 |
| 4,729,501 | A | * | 3/1988 | Lowrance | 227/117 |
| 4,930,289 | A | | 6/1990 | Fransson et al. | |
| 5,238,124 | A | * | 8/1993 | Cane et al. | 209/660 |
| 5,396,837 | A | * | 3/1995 | Backus | 99/590 |
| 5,737,902 | A | | 4/1998 | Aylward | |
| 5,845,810 | A | * | 12/1998 | Laznicka | 221/172 |
| 6,062,373 | A | * | 5/2000 | Onoguchi et al. | 198/625 |
| 6,241,100 | B1 | * | 6/2001 | Tanner et al. | 209/667 |
| 6,257,414 | B1 | * | 7/2001 | Gerhardt et al. | 209/667 |
| 6,357,495 | B1 | | 3/2002 | Baroncini | |
| 6,367,617 | B1 | * | 4/2002 | Schiesser et al. | 198/782 |
| 6,634,486 | B2 | * | 10/2003 | Bennett | 198/631.1 |

FOREIGN PATENT DOCUMENTS

| | | | |
|---|---|---|---|
| EP | 0399614 | A1 * | 11/1990 |
| FR | 1 420 280 | | 2/1966 |
| WO | WO 99/24333 | | 5/1999 |
| WO | WO 00/07881 | | 2/2000 |

* cited by examiner

DEVICE FOR INTRODUCING PHARMACEUTICAL PRODUCTS INTO BLISTER PACKS

PRIORITY CLAIM

This is a U.S. national stage of application No. PCT/CH2004/000185, filed on 26 Mar. 2004. Priority under 35 U.S.C. § 119(a) and 35 U.S.C. § 365(b) is claimed from Application No. 631/03, filed 8 Apr. 2003, in Switzerland.

BACKGROUND OF THE INVENTION

1. Field of the Invention

The invention pertains to a device for introducing solid pharmaceutical products into blister packs in which product such as tablets or capsules can be introduced by a distributing device from a pan into an isolating block and through isolating channels to the individual wells of the blister pack.

2. Description of the Related Art

Devices of this type are used when solid pharmaceutical products such as tablets, capsules, sugar-coated pills, and the like are to be loaded into blister packs. The basic goal is to supply exactly one product to each well of the blister pack.

A device of this type is known from DE 100 26 496 A1. From a supply container, in which the products are present as bulk material in completely random order, the products are gravity-fed to the individual wells of the blister pack by means of an isolating block.

A similar device for accomplishing the same task is known from U.S. Pat. No. 5,737,902 A.

A device for orienting asymmetric objects is known from FR 1,420,280 A. This device has a pair of counterrotating cylindrical rolls.

WO 99/24333 A1 describes a device for isolating agricultural products, by means of which the individual objects can be counted and weighed.

A device with which tablets can be packed in tubes is known from U.S. Pat. No. 4,930,289 A. The tubes can be sealed by counterrotating rolls.

A device with which tablets can be loaded into bottles is known from U.S. Pat. No. 2,829,476 A.

The products to be packaged come in many different forms. Tablets are often round and have a cylindrical center section, whereas the two end surfaces have a greater or lesser degree of convex curvature. They are also usually pressed from a preliminary product in the form of powder, which leads to the fact that the surface has a certain roughness. A groove can also be pressed into one of the end surfaces to make it easier to break the tablet in two. Products in the form of capsules and sugar-coated pills are also known.

In devices according to the state of the art, there is the problem that two or more such products can come in contact with each other at the entrance to the isolating block in such a way as to prevent the products from entering the channels of the isolating block. The products start to back up, and the device no longer operates correctly, because it can no longer fill all of the wells of the blister pack with a product. This leads to rejects and to production stoppages.

SUMMARY OF THE INVENTION

The invention is based on the task of reliably preventing the formation of such backups and thus of ensuring interruption-free production, in the course of which each well of the blister pack is supplied with one product.

According to the invention, the distributing device includes at least two pairs of rolls supported for rotation in a roll frame located below the pan, each pair of rolls consisting of a first roll and a second roll, each roll having a plurality of axially successive non-cylindrical sections. Each non-cylindrical section of each first is separated from a respective non-cylindrical section of the second roll by gap, wherein the is larger than the thickness of the pharmaceuical products. The first and second rolls of each pair are rotated in opposite directions so that surfaces of the rolls facing the gap move upwards. The isolating block has a matrix array of isolating channels which receive pharmaceutical products from respective gaps and distribute the products to a matrix array of individual wells in a blister pack in a single machine cycle.

BRIEF DESCRIPTION OF THE DRAWINGS

Exemplary embodiments of the invention are explained in greater detail below on the basis of the drawing.

DETAILED DESCRIPTION OF THE PRESENTLY PREFERRED EMBODIMENTS

Figure 1:
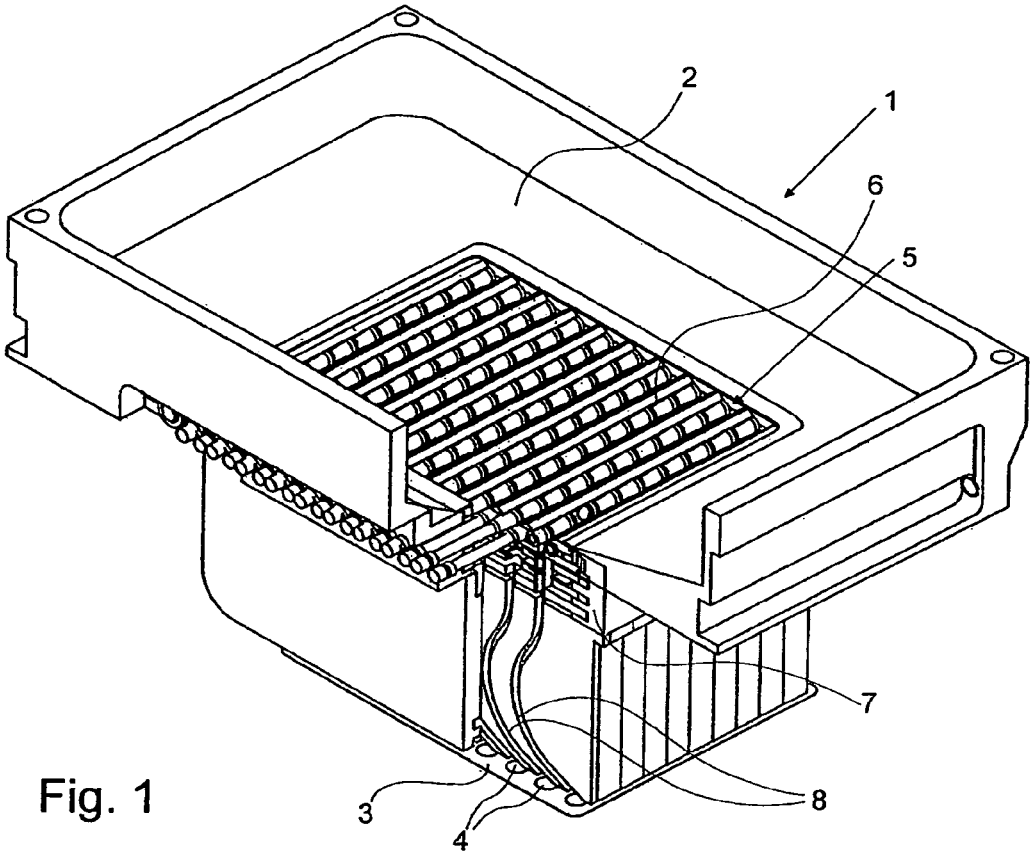
FIG. 1 shows an overall view of the device in partial cross section.

In FIG. 1, 1 designates a device for introducing solid pharmaceutical products into blister packs. The uppermost part of the device 1 consists of a pan 2, in which the products such as tablets, capsules, sugar-coated pills, and the like to be loaded into to the blister packs are present as bulk material. Underneath the device 1 is one of these blister packs 3 with individual wells 4, each of which holds one object. The bottom surface of the pan 2 has an opening 5, which is closed off by a horizontal distributing device 6. The design of the distributing device 6 will be described in detail further below. Under the distributing device 6 is an isolating block 7, which corresponds to the state of the art. Between the isolating block 7 and the blister pack 3, the objects to be packaged pass through isolating channels 8, one such isolating channel 8 being assigned to each well 4 of the blister pack 3.

Figure 2:
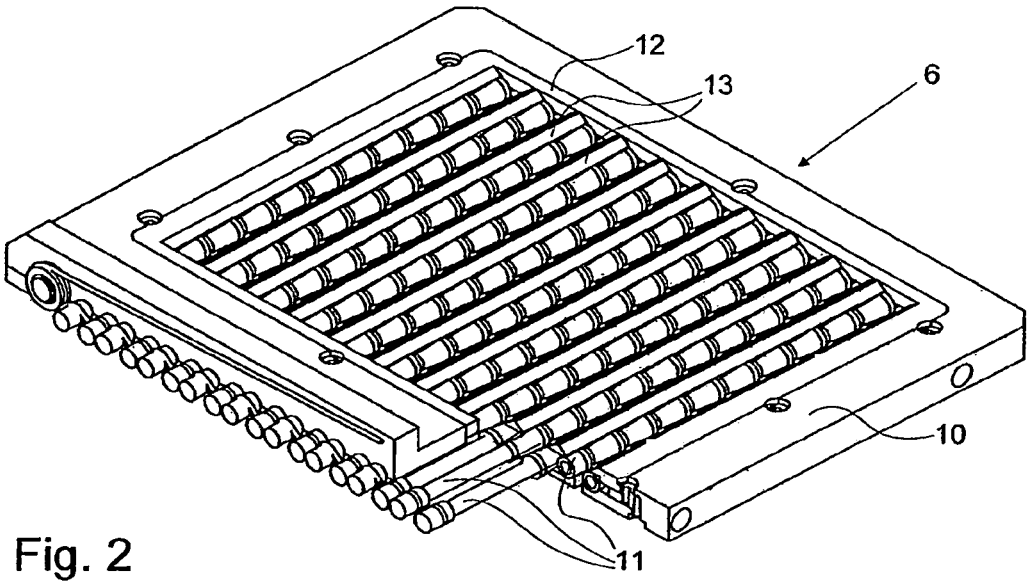
FIG. 2 shows an overall view of a distributing device.

FIG. 2 shows an overall view of the previously mentioned distributing device 6 in one of its inventive embodiments. In a roll frame 10, rolls 11 are supported with the freedom to rotate. As will be discussed again later, there are two different types of rolls 11, which alternate with, and are parallel to, each other. Above the rolls 11, a cover frame 12 is provided, which has individual webs 13 with a more-or-less triangular cross section.

Figure 3:
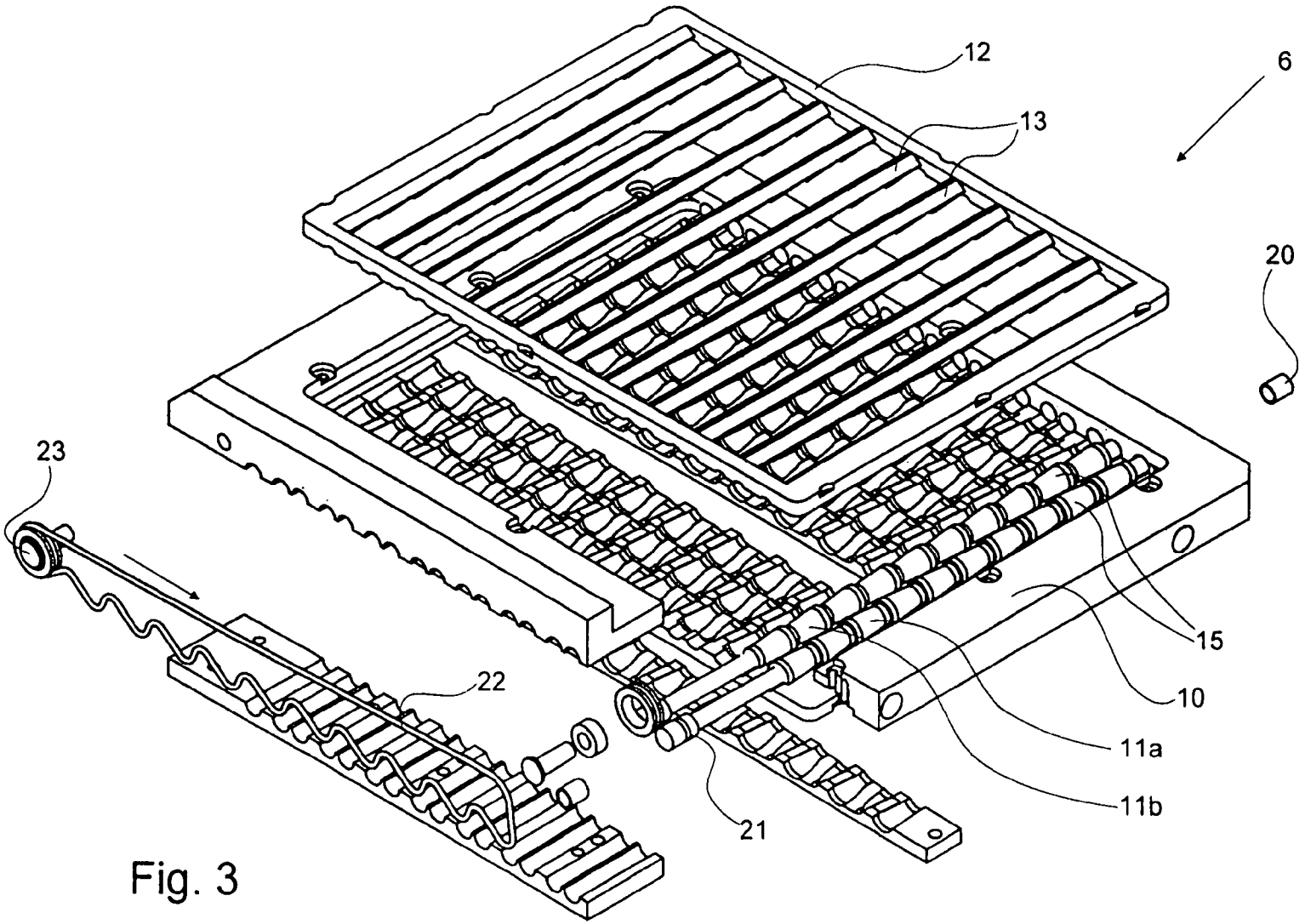
FIG. 3 shows an exploded view of the distributing device.

FIG. 3 shows the same distributing device 6 in the form of an exploded diagram. At the top is the cover frame 12 with its webs 13. Underneath is the roll frame 10, in which two types of rolls 11, namely, first rolls 11*a* and second rolls 11*b*, are arranged, always alternating with each other. One roll 11*a* forms a pair with the roll 11*b* located to its left. In this first exemplary embodiment, each of the rolls 11*a*, 11*b* has conical sections 15.

With respect to the spatial arrangement of the conical sections 15, there is a difference between the rolls 11*a* and the rolls 11*b*, namely, the angle of the conical sections 15 of the rolls 11*a* is exactly the opposite of the angle of the conical sections of the rolls 11*b*. This will be shown in greater detail later on. Thus the essential feature of the inventive design according to this exemplary embodiment is already presented. The other details of FIG. 3 show advantageous designs. This pertains, for example, to the bushings 20, which are installed in the roll frame 10, and in which the rolls 11*a*, 11*b* are rotatably supported. For the sake of clarity, only one of these bushings 20 is shown.

It is significant with respect to the invention, however, that the rolls 11, that is, the rolls 11*a* and 11*b*, project at one end from the roll frame 10, which could already be seen in FIG. 2. The reason for this measure is that the rolls 11*a*, 11*b* must be driven, and according to the invention the direction in which the rolls 11*a* rotate is opposite that in which the rolls 11*b* rotate. This will also be shown and described in more detail further below. It is advantageous for each roll 11*a*, 11*b* to have on this projecting end an annular groove 21, in which a belt 22 engages, which wraps part way around each of the rolls 11*a*, 11*b*. The belt 22 also runs around a belt tensioner 23. In this way, all the rolls 11*a*, 11*b* are connected to each other in a nonpositive manner. When the belt 22 is driven in one direction, as indicated by an arrow in FIG. 3, all the rolls 11*a* rotate in one direction and all the rolls 11*b* rotate in the opposite direction. The motorized drive itself can take various forms, any of which can be selected on the basis of the expert's experience and knowledge. For example, the belt tensioner 23 can be driven by a motor (not shown), or one of the rolls 11*a* or 11*b* can be driven. Because of the nonpositive connection produced by the belt 22, it is ensured that all the rolls 11*a*, 11*b* will rotate.

Figure 4:
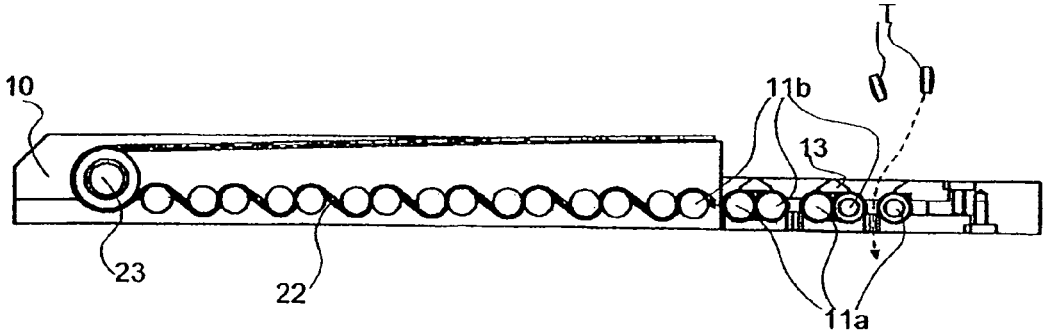
FIG. 4 shows a side view of a roll frame with driven rolls.

This design can also be seen in FIG. 4, which shows a side view of the roll frame 10 with the driven rolls 11*a*, 11*b*, where, in analogy to FIGS. 1-3, a partial cross section appears on the right. Visible here again are the rolls 11*a* and 11*b* in the roll frame 10, the belt 22, and the belt tensioner 23. The triangular cross section of the webs 13 of the cover frame 12 can also be seen here.

Also appearing in the figure are two tablets T and the route, indicated in the broken line, to be taken by one of them between two adjacent rolls 11*a* and 11*b* in the direction toward the isolating channel 8 (FIG. 1), not shown here. These isolating channels 8 begin underneath the gap between the adjacent rolls 11*a*, 11*b*.

Figure 5:
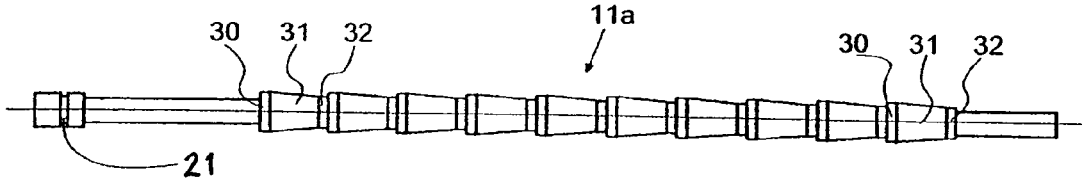
FIG. 5 shows a view of a roll.

FIG. 5 shows a side view of a roll 11. The example shows a roll 11*a*. At one end, as already indicated in FIG. 3, it has an annular groove 21, in which the belt 22 (FIGS. 3 and 4) engages. According to the invention, the roll 11*a* has noncylindrical sections. The design of the noncylindrical sections is closely related to the shape of the pharmaceutical product to be packaged.

A first exemplary embodiment, which will be used when the products to be packaged are tablets T, is explained in greater detail below. In this case, it is advantageous for the rolls 11*a* to have a periodic sequence of three special sections, in which a first cylindrical section 30 with a certain larger diameter $D_1$ is followed by a noncylindrical section 31, which is followed in turn by a second cylindrical section 32 with a certain smaller diameter $D_2$. The noncylindrical section 31 has the shape of a truncated cone. The sequence of sections 30, 31, 32 repeats several times over the length of the roll 11*a*. The truncated cone-shaped section 31 has the larger diameter $D_1$ on the end facing the first cylindrical section 30 and the smaller diameter $D_2$ at the end facing the second cylindrical section 32.

The dimensions of the sections 30, 31, 32 are related to the shape and size of the tablets T to be isolated by the device (FIG. 4). Thus, for example, the overall length of a periodic sequence of the sections 30, 31, 32 is approximately 14 mm, where each of the sections 30 and 32 is 2 mm long, and the truncated cone-shaped section 31 accounts for the remaining length of approximately 10 mm. The ratio of the diameters $D_1$, $D_2$ is calculated more-or-less so that the conical surface has an angle of approximately 5° to the axis of the roll 11*a*. The previously mentioned dimensions are to be understood as examples for a certain shape and size of tablet. Depending on the shape and size of the tablets T, these dimensions can vary in practice to a greater or lesser degree.

Figure 6:
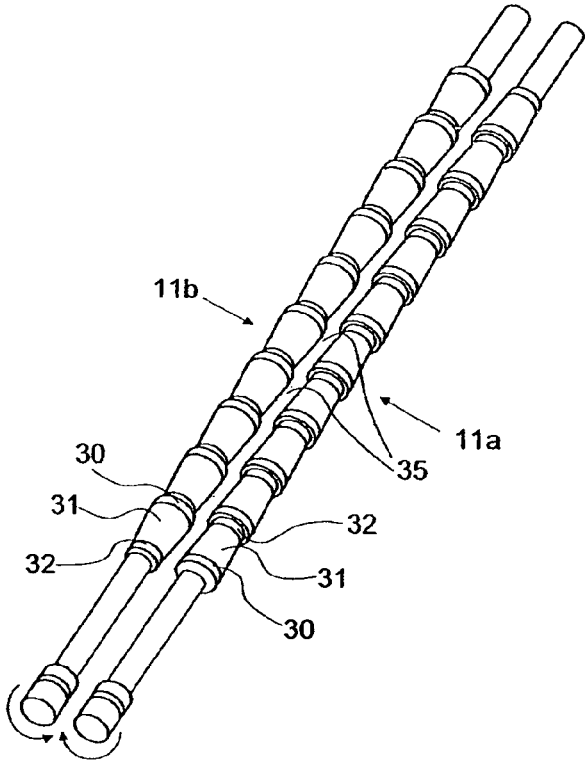
FIG. 6 shows a perspective view of two rolls.

FIG. 6 shows a perspective view of two adjacent rolls, namely, a first roll 11*a* on the right and a second roll 11*b* on the left. This thus represents another illustration of the rolls 11*a* and 11*b* already shown in FIG. 3. What is essential to the invention, however, is that the sequence of the sections 30, 31, 32 and the rotational direction, indicated by arrows in FIG. 6, of the rolls 11*a* are opposite the sequence and the direction of the rolls 11*b*. Between the two rolls 11*a* and 11*b* there is a gap 35, through which the tablets T (FIG. 4) can pass. The gap 35 is therefore larger by a certain amount than the thickness of the tablets 4. If, as in this exemplary embodiment, the noncylindrical sections 31 are in the form of truncated cones, the gap 35 will have a constant width.

If we now consider FIG. 6 together with FIG. 4, we see that the tablets T can pass only through the gap 35 between the roll 11*a* on the right and the roll 11*b* on the left. It can be seen in FIG. 4 that the tablets T cannot pass through between a roll 11*b* on the right and a roll 11*a* adjacent on the left, first, because these two rolls 11*a*, 11*b* are so close together that the tablets T cannot pass between them, and, second, because a web 13 is positioned above them. Because this web has a triangular cross section with one vertex pointing upward and the other two vertices being on the same level at the bottom, each web 13 has a slanted surface on each side, along which the tablets T slide in such a way that the only the route which they can take is that between a roll 11*a* on the right and a roll 11*b* on the left. The route between a roll 11*b* on the right and an adjacent roll 11*a* on the left is blocked by the web 13.

The difference in the rotational directions of the rolls 11*a* and 11*b* is extremely important for the accomplishment of the inventive task. Because the rolls 11*a* rotate clockwise and the rolls 11*b* rotate counterclockwise, as seen from the ends of the rolls, the lateral surfaces of the sections 30, 31, 32, seen from the gap 35, move upward. When there is contact between a point on a tablet T with one of the lateral surfaces of the sections 30, 31, 32, therefore, a force is exerted on the tablet T which is opposite the effect which gravity is exerting on the tablet. As a result, it is impossible for a tablet T which is occupying a slanted position between the rotating rolls 11*a*, 11*b* to be pulled into the gap, where it could become jammed in place or damaged.

If two tablets T were to be situated next to each other above the gap 35, they would be carried upward by the lateral surfaces of one of the sections 30, 31, 32. Because the tablets T are in completely random order as bulk material in the space above the gap 35, the two tablets T are in contact with other tablets T. It can thus be assumed that the forces acting on one of the individual tablets T will be different than the forces acting on the other one, a fact which always leads to the result that the backup caused by two adjacent tablets T will be quickly cleared away. Experiments have confirmed this.

Whenever a tablet T occupies a position in space such that the tablet T can easily drop through the gap 35, the tablet T will pass through gap 35.

Because the tablets T are in completely random order as bulk material in the pan 2 and because each one can assume any position in space, the tablets T must be rotated in such a way that they can fall through the gap 35 by the force of gravity. This is already done to a certain extent by the interactions among the individual tablets T.

Figure 7A:
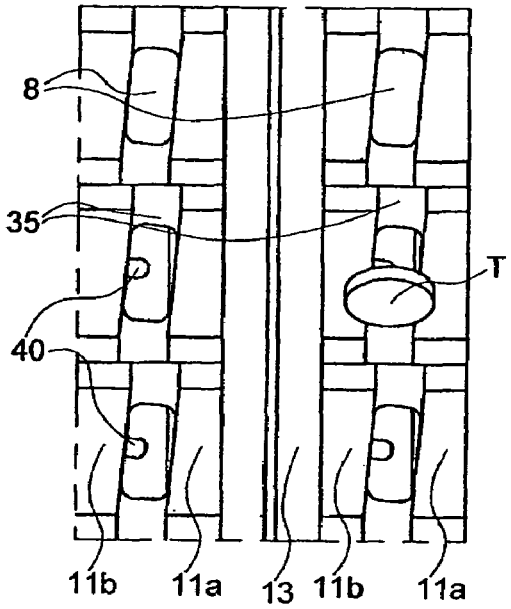
FIGS. 7*a*-7*c* show partial plan views of the rolls of the distributing device with a tablet located above the rolls.
Figure 7B:
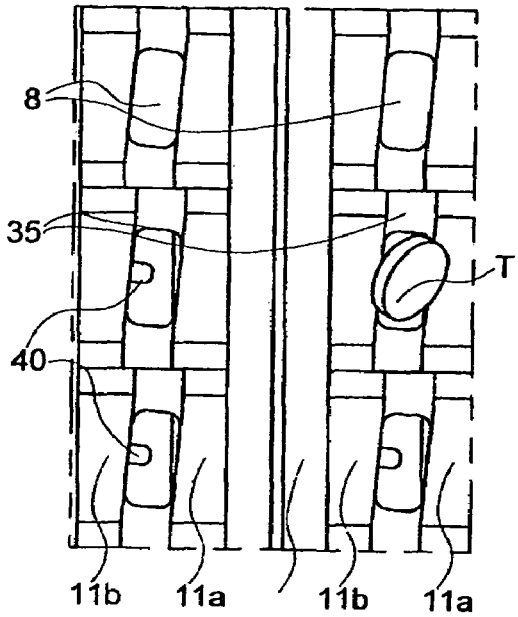
Figure 7C:
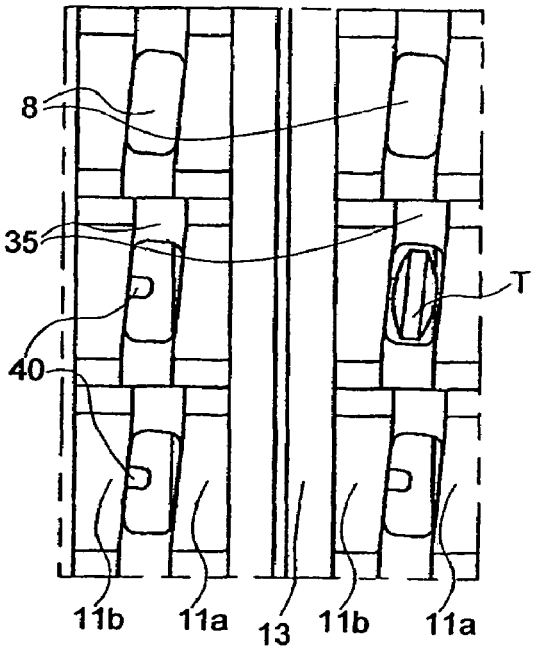

On the basis of the following FIGS. 7*a*-7*c*, it is now shown that the tablets T are rotated completely automatically by the noncylindrical sections 31, here in the form of truncated cones, of the two rolls 11*a*, 11*b* in such a way that they can fall through the gap 35. FIGS. 7*a*-7*c* show top views of the web 13, which is in the center. To the left and right are parts of the rolls 11*a*, 11*b*, and the gap 35, which is present between the rolls 11*a*, 11*b*. The isolating channels 8 already shown in FIG. 1 can also be seen in these plan views. An upper blocking slide 40 can be seen in some of these isolating channels 8. These slides are provided in all of the isolating channels 8. The upper blocking slides 40 belong to the isolating block 7 (FIG. 1). This will be discussed again in conjunction with the following FIGS. 8, 9, and 10.

FIG. 7*a* shows the least favorable case in which a tablet T is positioned transversely to the gap 35 and to the axes of the rolls 11*a*, 11*b*. For the sake of clarity, only a single tablet T is shown, so that the action of the rotating rolls 11*a*, 11*b* can be explained more clearly. When we consider the position of the tablet T, we see that it rests on the rolls 11*a*, 11*b* at a minimum of two points. At the contact points, the roll 11*b* on the left of the tablet T has a smaller diameter than the roll 11*a* on the right of the tablet T. The rolls 11*a* and 11*b* rotate in different directions, as can be seen in FIG. 6. It has been found that, as a result of this rotation of the rolls 11*a*, 11*b*, a force is exerted on the tablet T which causes the tablet T to rotate.

FIG. 7*b* shows the next position of the tablet produced by this rotation of the tablet T. The rotation continues and finally leads to the position of the tablet T shown in FIG. 7*c*. It has thus arrived in a position in which it can drop under the effect of gravity between the rolls 11*a* and 11*b* and into the isolating channel 8 underneath until it rests on the upper blocking slide 40 belonging to the isolating channel 8.

What has been shown here on the basis of a single tablet T takes place more-or-less simultaneously at all the similar locations of all the rolls 11*a*, 11*b*. Tablets T are thus supplied in this way to all of the isolating channels 8.

Figure 8:
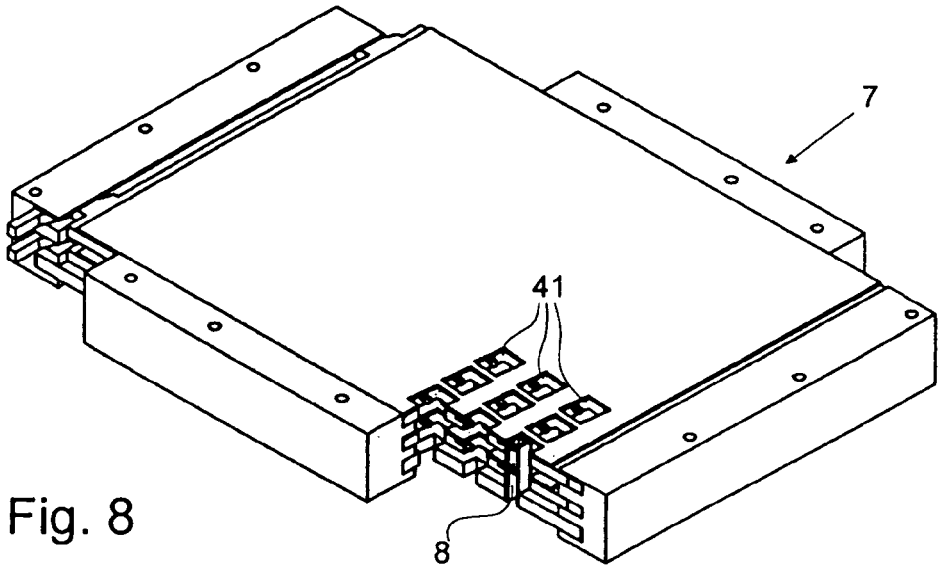
FIG. 8 shows a view of an isolating block.
Figure 9:
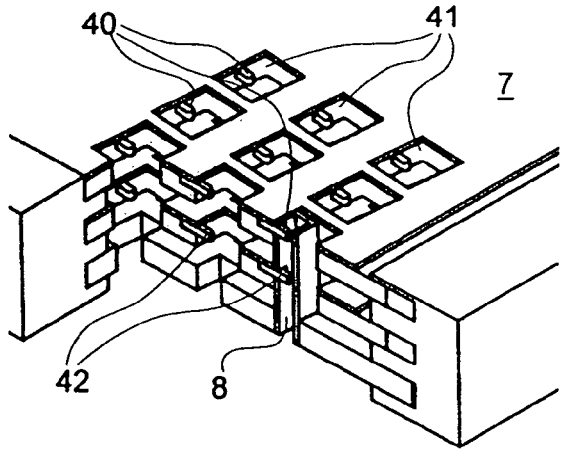
FIG. 9 shows a detail of the block.
Figure 10:
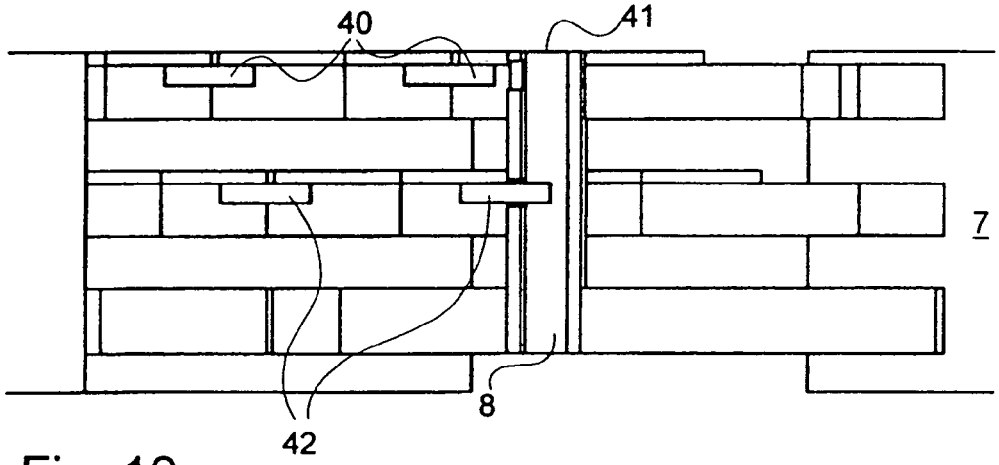
FIG. 10 shows a cross-sectional view of the block.

FIGS. 8, 9, and 10 show the isolating block 7 already familiar from FIG. 1. This block is largely the same as that according to the known state of the art, but it is described briefly here for the sake of completeness.

FIG. 8 shows a partial cross section through the isolating block 7. Entrance openings 41 of the previously mentioned isolating channels 8 (FIGS. 1, 7*a*-*c*) are found on the top surface of the isolating block. Only nine of these entrance openings 41 are shown. The entrance openings 41 are arranged in rows, each row having as many entrance openings as there are truncated cone-shaped sections 31 on the rolls 11*a*, 11*b* (FIG. 5). There would therefore be ten of them, as can be seen in FIGS. 5 and 6. The number of rows of entrance openings 41 corresponds to the number of pairs of rolls 11*a*, 11*b*, which would therefore also be 10, for example, as can be seen in FIG. 2. Thus there are a total of one hundred entrance openings 41 and correspondingly a total of one hundred isolating channels 8, so that tablets T can be supplied simultaneously to one hundred wells 4 (FIG. 1) of a blister pack 3.

It should be emphasized here, however, that the invention is not limited to this matrix-like arrangement. The principle of the invention, namely, that two differently designed rolls 11*a*, 11*b* with noncylindrical sections 31 rotate in opposite directions, can also be applied in the form that only a single pair of rolls 11*a*, 11*b* is used. In this case, only one row of wells 4 (FIG. 1) of a blister pack will be filled with product during each work cycle. In the case of the matrix-like arrangement shown with a plurality of rolls 11*a*, 11*b*, it is possible to fill all the wells 4 of a blister pack 3 simultaneously, which obviously results in a significant increase in production output. This is a significant advantage.

FIG. 9 shows a magnified view of part of the isolating block 7 according to FIG. 8. Here it can be seen that the upper blocking slide 40 already known from FIGS. 7*a*-7*c* is located underneath the entrance opening 41. One of these upper blocking slides 40 is present in each of the isolating channels 8. In addition, a lower blocking slide 42 is positioned in each of the isolating channels 8 underneath the upper blocking slide 40. The free distance between the upper blocking slides 40 and the lower blocking slides 42 is slightly larger than the diameter of the tablets T (FIGS. 7*a*-7*c*).

FIG. 10 shows a cross-sectional side view of the isolating block 7 according to FIG. 9. Upper blocking slides 40 and lower blocking slides 42 are shown, which are assigned to each of the isolating channels 8. The upper blocking slides 40 are shown in their retracted position. In this position, a tablet T (FIGS. 7*a*-7*c*) entering one of the isolating channels 8 through the entrance opening 41 can fall through to the lower blocking slide 42. The lower blocking slides 42 are located here in the extended position, which makes it impossible for the tablets T to go any farther.

Then the upper blocking slides 40 are moved into the extended position in the known manner, so that no tablets T can come from behind from the distributing device 6. Then the lower blocking slide 42 is moved into the retracted position. As a result, the tablet T can fall through the following section of the isolating channel 8, as can be seen in FIG. 1, and drop into the well 4 of the blister pack 3.

In the exemplary embodiment shown, ten rows of ten isolating channels 8 are present. Thus, blister packs with one hundred wells 4 can be filled with tablets T, where all hundred wells 4 are filled simultaneously. The number of rows and the number of isolating channels 8 in the individual rows depend on how many wells 4 there are in the blister pack 3. It is therefore possible to fill a blister pack 3 completely in a single step. As a result, a very high packaging rate is achieved.

It is important that the tablets should not become jammed up in the distributing device 6 (FIG. 2), because this would prevent a tablet T from entering an isolating channel 8 during a work cycle. If that were to happen, a tablet T would be missing from the blister pack 3, which would mean in turn that the product would have to be rejected. As a result of the invention, the goal is now achieved that such jams cannot occur, with the result that uniform production output is achieved without rejects. In addition, a very high cycle rate can be reached in the filling of blister packs 3. The cycle rates which can be achieved through the invention are much higher that those possible according to the state of the art.

The inventive device is especially advantageous when tablets T with a groove for breaking are to be packaged. These grooves increase the number of jams which occur in the conventional devices.

The increase in the cycle rate, the avoidance of jams, and the avoidance of the production stoppages caused by jams lead to more economical operation.

A first exemplary embodiment suitable for the filling of blister packs 3 with tablets T has been presented above. Solid pharmaceutical products can also have different shapes and very different dimensions. In addition, the products do not have to be tablets T pressed from powder. Sugar-coated pills, two-part capsules, and soft gelatin capsules, for example, are also known.

Figure 11:
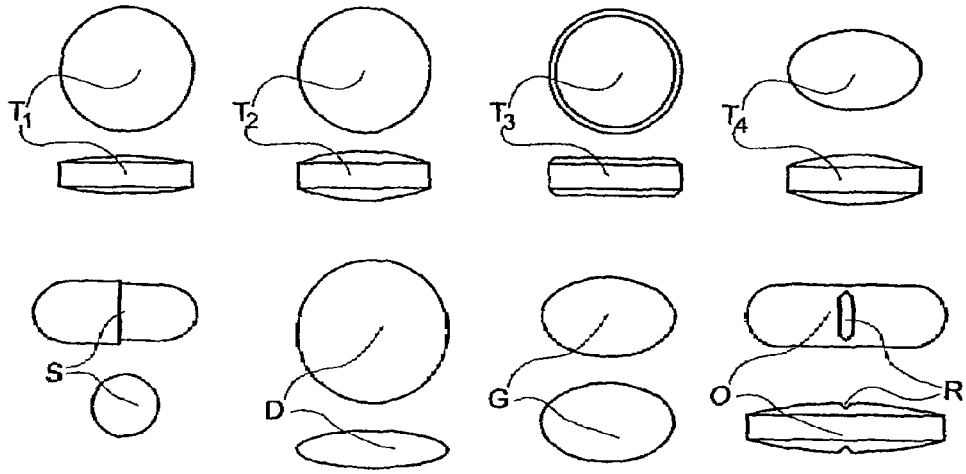
FIG. 11 shows various forms of solid pharmaceutical products.

FIG. 11 shows top and side views of various types of solid pharmaceutical products. In the upper row, on the left, is a first form of tablet T, designated $T_1$. This tablet is round and has a cylindrical center section and convex top and bottom surfaces, where the radius of curvature is relatively large. Next on the right is a second form of tablet T, designated $T_2$. This is also round and has a cylindrical center section and convex top and bottom surfaces, but the radius of curvature is much smaller than that of the first example. Further toward the right is a third form of tablet T designated $T_3$. This form is round and cylindrical and has bevels on both sides. On the extreme right in the upper row is a fourth form of tablet T designated $T_4$. It looks the same from the side as the second form, but, as the top view shows, it is not round but oval.

In the bottom row on the left is a solid pharmaceutical product in the form of a two-part capsule S. Next to it on the right is the form of a sugar-coated pill D. These sugar-coated pills are another standard form of administration for pharmaceutical products. Although the round form is shown here, oval forms are also known. Further to the right is the form of a gelatin capsule G. These are often in the form of a rotational ellipsoid. Finally, at the extreme right, as yet another embodiment, is a form of a tablet T with an elongated form called an "oblong" O in professional circles. As an example, this tablet also has a groove R for breaking, which can be present in any of the various other forms of the tablet T.

Many pharmaceutical manufacturers are constantly creating new forms such as rhomboidal, triangular, pentagonal, and hexagonal shapes. Such special forms often lead to considerable problems with the job of introducing the tablets into the blister packs 3. Within the scope of the present invention, however, even solid pharmaceutical products with these special shapes can be packaged with ease.

It is obvious that the shapes of the rolls 11*a*, 11*b* must be designed to accommodate the specific type of solid pharmaceutical product. By way of example, several special advantageous designs for the rolls 11*a*, 11*b* are shown. The diagram is not exclusive. For additional types of products, some of which are shown in FIG. 11, different roll designs will be advantageous and can be used without abandoning the principle of the invention.

Figure 12A:
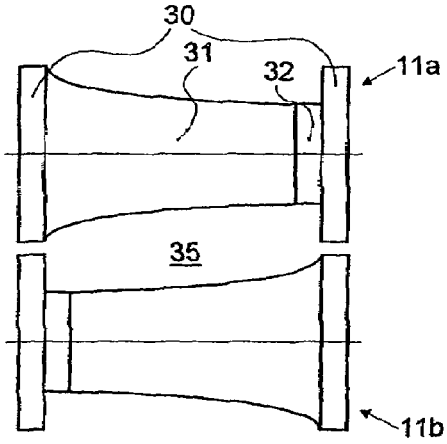
FIGS. 12*a*-12*b* show design variants of the rolls.
Figure 12B:
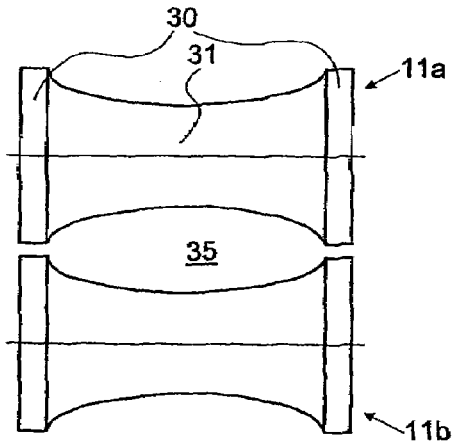

Without claiming to be exhaustive, FIGS. 12 and 12*b* show several special designs of the rolls 11*a*, 11*b*, which lie within the scope of the inventive principle. Each shows a plan view of parts of the two rolls 11*a*, 11*b*, representing sections removed from rolls analogous to those shown in FIG. 6. What is shown therefore is a part of the repeating sequence of individual sections 30, 31, 32 shown in FIGS. 5 and 6, extending along the length of the rolls 11*a*, 11*b*.

The example shown in FIG. 12*a* is characterized in that that noncylindrical section 31 does not have a conical form but rather represents a segment of a parabola. As a result, the gap 35 is not uniform in width along its entire extent. As also shown in FIG. 6, the rolls 11*a*, 11*b* are again mirror images of each other with respect to the sequence of sections 30, 31, 32. This form of the rolls 11*a*, 11*b* is suitable for solid pharmaceutical products with highly curved top and bottom surfaces.

The example shown in FIG. 12*b* is similar. The second cylindrical section 32 is lacking here, however. Between two sections 30, the noncylindrical section 31 is designed so that it has a hyperbolic form. Because the hyperbolic form is the same for both rolls 11*a*, 11*b*, the two rolls 11*a*, 11*b* are therefore identical. This roll form is especially suitable for elongated pharmaceutical products such as two-part capsules S (FIG. 11) and oblongs.

Figure 13:
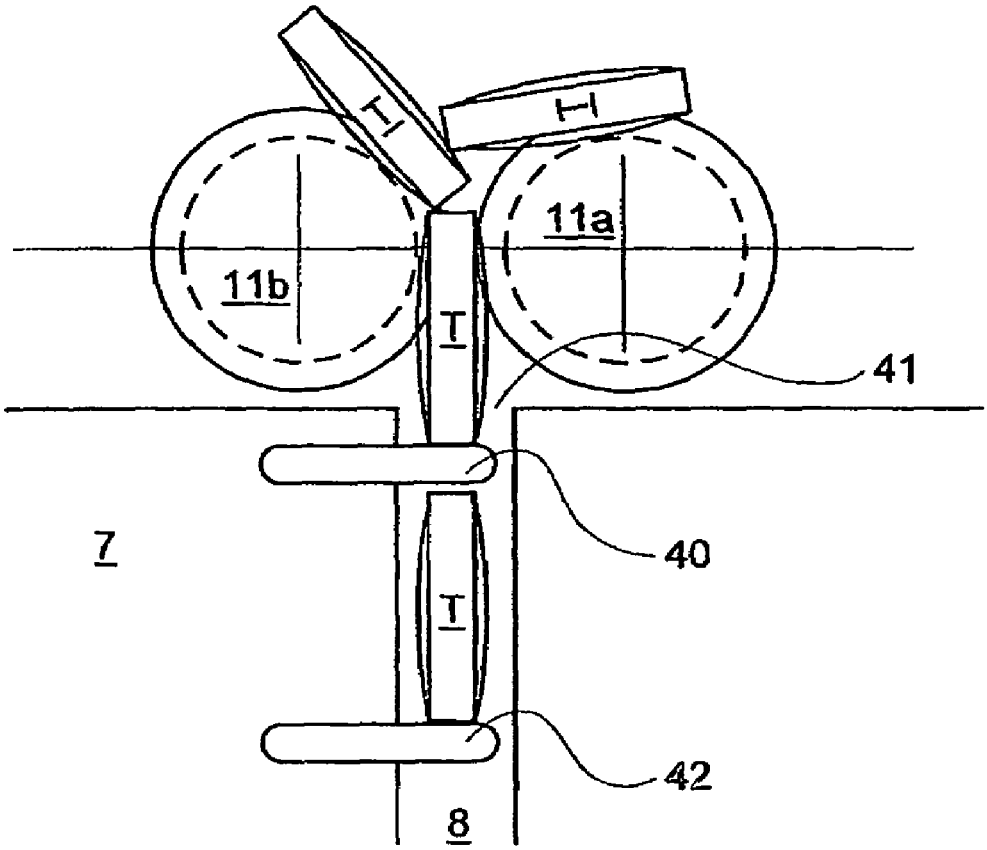
FIG. 13 shows a diagram of the placement of the rolls above the isolating block.

FIG. 13 shows a diagram of the placement of the rolls 11*a*, 11*b* above the isolating block 7 (FIG. 1). We see an isolating channel 8 and the associated entrance opening 41 with the upper blocking slide 40 and the lower blocking slide 42. The free distance between the upper blocking slide 40 and the lower blocking slide 42 is slightly larger than the height of a tablet T. It is also important, which is why this detail is shown here, that the position of the rolls 11*a*, 11*b* above the isolating block 7 is such that only a single tablet T can assume a vertical position in the space between the rolls 11*a*, 11*b* and above the upper blocking slide 40, i.e., a position suitable for introduction into the blister pack 3 (FIG. 1). The distance between the upper edge of the upper blocking slide 40 and the connecting line between the axes of the rolls 11*a*, 11*b* is therefore significant here. This distance should not be greater than the height of a tablet T. When this condition is satisfied, the result is that the other tablets T present above the connecting line will never, in practice, be able to stand vertically. Instead, because of the interaction of forces among them and the position of the noncylindrical sections 31 (FIG. 5) (not shown here), they will all be positioned at a pronounced angle. They then get in each other's way, so that none of the tablets T present in the upper area will be able to fall through to the upper blocking slide 40 when it is pulled back to allow the tablet already resting on the upper blocking slide 40 to drop down to the lower blocking slide 42. The next tablet T cannot be oriented in the manner described on the basis of FIGS. 7*a*-7*c* until the rolls 11*a*, 11*b* have rotated by a certain amount.

Because there are forms of such pharmaceutical products which can be oriented relatively easily, such as sugar-coated pills and the two-part capsules with their normally smooth surfaces, it can be advantageous for the rotational movement of the rolls 11*a*, 11*b* to proceed not continuously but rather discontinuously. It can be advantageous, for example, to stop the rotational movement before the upper blocking slide 40 is moved from the extended position shown in FIG. 13 back into the retracted position shown in FIG. 10.

It can also be advantageous for the rotational speed of the rolls 11*a*, 11*b* not to be the same but rather different. This can be achieved, for example, by providing separate drive motors, one for the first rolls 11*a* and one for the second rolls 11*b*. In the case of a drive with a belt 22 such as that shown in FIG. 3, however, it is possible for the rolls 11*a* and 11*b* to have different diameters at the ends with the annular grooves 21.

In an application of the inventive principle, any type of solid pharmaceutical product, namely, tablets T of different shapes and sizes, as well as two-part capsules S, sugar-coated pills D, gelatin capsules G, oblongs O, and other forms can be loaded into the blister packs 3 (FIG. 1) in a highly economical and reliable manner.

The invention claimed is:

1. A device for introducing solid pharmaceutical products having a thickness into a matrix array of individuals wells of a blister pack, the device comprising:

a pan for receiving pharmaceutical products loaded as bulk material;

at least two pairs of rolls supported for rotation in a roll frame located below the pan, each pair of rolls consisting of a first roll and a second roll, each said roll having a plurality of axially successive non-cylindrical sections, each said non-cylindrical section of each said first roll being separated from a respective said non-cylindrical section of the second roll by a gap, wherein the gap is larger than the thickness of the pharmaceutical products;

drive means for rotating the first and second rolls of each said pair in opposite directions so that surfaces of the rolls facing the gap move upwards; and an isolating block positioned below the rolls, the isolating block having a matrix array of isolating channels for receiving respective said pharmaceutical products from respective said gaps and for distributing said pharmaceutical products to respective individual wells of a blister pack.

2. The device of claim 1, wherein the noncylindrical sections are conically shaped and are oriented so that the gaps each have a uniform width.

3. The device of claim 1, wherein the noncylindrical sections of the first and second rolls each have the form of a segment of a parabola.

4. The device of claim 1, wherein the noncylindrical sections of the first and second rolls each are hyperbolically shaped.

5. The device of claim 1, further comprising a cover frame having a web extending parallel to axes of the rolls, and configured and positioned to prevent the individual pharmaceutical products from passing between pairs of rolls and to permit the individual pharmaceutical products to pass between the first and second rolls of a pair of rolls.

6. The device of claim 5, wherein the web has a substantially triangular cross-section and is oriented so that slanted surfaces of the web guide the pharmaceutical products towards the gaps between the first and second rolls of each roll pair.

7. The device of claim 1, wherein the drive means comprises a motor driven device.

8. The device of claim 7, wherein the motor driven device comprises an endless belt operatively connected to the rolls.

9. The device of claim 8 wherein the endless belt directly engages ends of the first and second rolls.

10. The device of claim 9 wherein the ends of the first and second rolls are provided with respective annular grooves in which the endless belt engages.

11. The device of claim 1, wherein the first and second rolls rotate at different rotational speeds.

12. The device of claim 11, wherein the drive means are operatively connected to a driven end of each of the first and second rolls, and the driven end of each said first roll has a different diameter than the driven end of each said second roll.

13. The device of claim 1, wherein the drive means comprise a first motorized drive for the first rolls and a second motorized drive for the second rolls.

14. The device of claim 1 wherein said first and second rolls each have at least one cylindrical section between axially successive non-cylindrical sections.

* * * * *